United States Patent [19]

Crosby et al.

[11] Patent Number: 4,695,262

[45] Date of Patent: Sep. 22, 1987

[54] TOY ROTATING GEAR ACCESSORY FOR USE WITH GYROSCOPIC TOP

[75] Inventors: Michael A. Crosby, Hawthorne; Art J. Foss, Torrance, both of Calif.

[73] Assignee: Mattel, Inc., Hawthorne, Calif.

[21] Appl. No.: 877,580

[22] Filed: Jun. 23, 1986

[51] Int. Cl.[4] ..... A63H 1/00

[52] U.S. Cl. ..... 446/236; 74/206; 74/421 R; 74/DIG. 10; 446/256

[58] Field of Search ..... 446/102, 236, 256; 74/421 R, 206, 325, DIG. 10

[56] References Cited

U.S. PATENT DOCUMENTS

| | | | |
|---|---|---|---|
| Re. 30,299 | 6/1980 | Greenwood . | |
| 99,644 | 2/1870 | Coombs . | |
| 768,268 | 7/1904 | Clark . | |
| 944,096 | 12/1909 | Kirkby . | |
| 960,715 | 6/1910 | Schneider . | |
| 1,021,926 | 4/1912 | Gibbs | 446/256 |
| 1,821,940 | 9/1931 | Hinsen . | |
| 2,477,441 | 7/1949 | Cole | 446/236 X |
| 2,736,132 | 2/1956 | Murray . | |
| 3,181,555 | 5/1965 | Jacobson | 74/DIG. 10 |
| 3,674,271 | 7/1972 | De Gelder et al. . | |
| 3,932,957 | 1/1976 | Morrison et al. . | |
| 4,203,251 | 5/1980 | Malek et al. | 446/236 |
| 4,374,480 | 2/1983 | Diaz | 74/421 R X |
| 4,555,237 | 11/1985 | Nikaido . | |
| 4,556,396 | 12/1985 | Kennedy et al. . | |

FOREIGN PATENT DOCUMENTS 2755883 6/1978 Fed. Rep. of Germany ..... 446/102

*Primary Examiner*—Kenneth J. Dorner
*Assistant Examiner*—James R. Brittain
*Attorney, Agent, or Firm*—Ronald M. Goldman; Melvin A. Klein; Daniel F. Sullivan

[57] ABSTRACT

A toy rotating gear accessory which may be used in conjunction with a gyroscopic top. The accessory has a supporting body with a number of apertures passing through it. One or more circular gears may be removably attached to the supporting body by segmented flexible members located on the top surfaces of the gears. The flexible members may be inserted into or slid out of the apertures in the supporting body by simply bending the members. After the gears are attached to the supporting body, they are free to rotate with respect to the body. Protuberances located on the top surface of each gear help to reduce friction between the gears and the supporting body. Supports located on the bottom surfaces of the gears support the accessory on a horizontal surface. During play, a child may insert the rotating portion of a gyroscopic top into a cylindrical bore located on the upper surface of one of the gears. This causes the gear to rotate and the entire accessory to rotate about the center of the gear. The teeth of the rotating gear engage the teeth of adjacent gears causing all of the gears to rotate at the same time. The toy rotating gear accessory may be used with one or more gears.

5 Claims, 6 Drawing Figures

TOY ROTATING GEAR ACCESSORY FOR USE WITH GYROSCOPIC TOP

BACKGROUND OF THE INVENTION

The present invention relates generally to gyroscopic toy accessories and, more particularly, to a toy rotating gear accessory which may be used in conjunction with a gyroscopic top.

In the past, a variety of gyroscopic figure toys have been used by children during play such as those disclosed in U.S. Pat. Nos. 2,736,132 issued to Murray on Feb. 28, 1956 and 99,644 issued to Coombs on Feb. 8, 1870. Flywheels are used to rotate gears and/or provide a gyroscopic effect in U.S. Pat. Nos. 4,556,396 issued to Kennedy et al on Dec. 3, 1985 (Toy Vehicle); 4,555,237 issued to Nikaido on Nov. 26, 1985 (Walking and Rolling Toy); Re. 30,299 reissued to Greenwood on June 10, 1980 (Toy Vehicle); 3,932,957 issued to Morrison et al on Jan. 20, 1976 (Toy Vehicle); 1,821,940 issued to Hinsen on Sept. 8, 1931 (Toy Vehicle); and 768,268 issued to Clark on Aug. 23, 1904 (Locomotive Toy). Finally, gyroscopic toys or tops are used in conjunction with different accessories in U.S. Pat. Nos. 3,674,271 issued to De Gelder et al on July 4, 1972 (Surface Tray Assembly for Toy Top); 960,715 issued to Schneider on June 7, 1910 (Magnetized Serpentine Element for Toy Top); and 944,096 issued to Kirkby on Dec. 21, 1909 (Track for Gyroscopic Toy).

None of the above patents describes.a toy accessory featuring rotating gears which may be used in conjunction with a gyroscopic top. Such an accessory would be particularly enjoyable to a child if the child is able to observe one or more gears coupled to the accessory which are rotating during play. Accordingly, there is a need in the toy manufacturing arts for a toy rotating gear accessory which may be used with a gyroscopic top.

SUMMARY OF THE INVENTION

It is the object of this invention to provide a toy rotating gear accessory which may be used in conjunction with a gyroscopic top.

It is another object of this invention to provide a toy rotating gear accessory having one or more rotating gears removably coupled to it, each of the gears being adapted to individually engage a gyroscopic top.

It is still another object of this invention to provide a toy rotating gear accessory which will support a gyroscopic top on a horizontal playing surface.

These and other objects and advantages are attained by a toy rotating gear accessory which may be used in conjunction with a gyroscopic top. The accessory has a supporting body with a number of apertures passing through it. One or more circular gears may be removably attached to the supporting body by segmented flexible members located on the top surfaces of the gears. The flexible members may be inserted into or slid out of the apertures in the supporting body by simply bending the members. After the gears are attached to the supporting body, they are free to rotate with respect to the body. Protuberances located on the top surface of each gear help to reduce friction between the gears and the supporting body. Supports located on the bottom surfaces of the gears support the accessory on a horizontal surface. During play, a child may insert the rotating portion of a gyroscopic top into a cylindrical bore located on the upper surface of one of the gears. This causes the gear to rotate and the entire accessory to rotate about the center of the gear. The teeth of the rotating gear engage the teeth of adjacent gears causing all of the gears to rotate at the same time. The rotating gear accessory may be used with one or more gears.

The various features of the present invention will be best understood, together with further objects and advantages by reference to the following description of the preferred embodiment, taken in connection with the accompanying drawings.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a conmercial environment, although it should be understood that various modifications can be accomplished within the parameters of the present invention.

Figure 1:
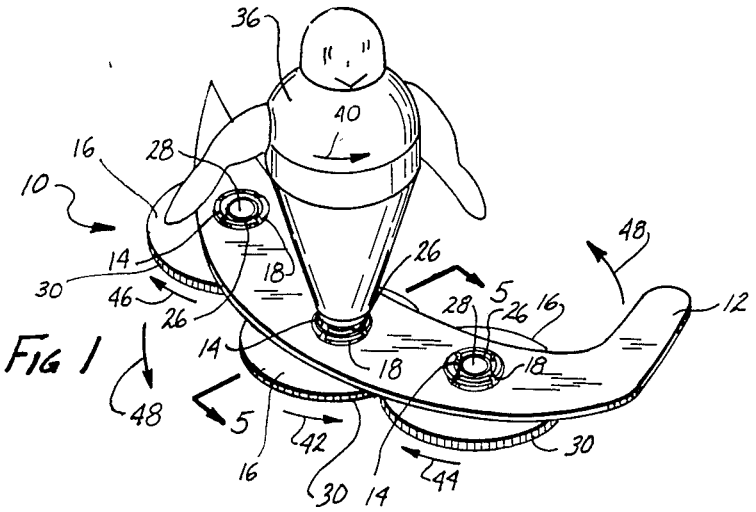
FIG. 1 is a perspective view showing how a toy rotating gear accessory of the present invention can be used in conjunction with a gyroscropic top.
Figure 6:
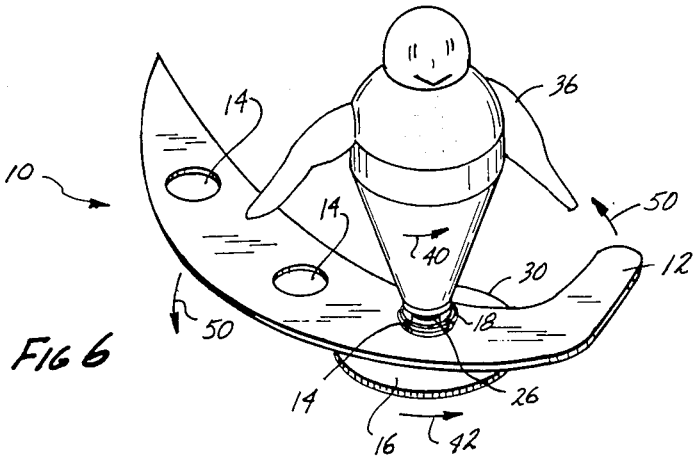
FIG. 6 is a perspective view showing two of the gears removed with the gyroscopic top engaging the remaining gear.

Referring now to the drawings and particularly to FIGS. 1 and 6, a preferred embodiment of the toy rotating gear accessory 10 of the present invention is disclosed. The toy rotating gear accessory 10 has a supporting body 12 with a number of apertures 14 extending through it. Only three apertures 14 are shown, but any number can be used. Also, the supporting body 12 may have any desired shape so long as the apertures 14 extend through the body. A relatively flat body 12 is preferred. The toy rotating gear accessory 10 shown in FIG. 1 has three gears 16 removably attached to it. However, the number of gears 16 used with the accessory 10 may be varied. For example, only one gear 16 may be attached to the supporting body 12 if desired as shown in FIG. 6.

Figure 2:
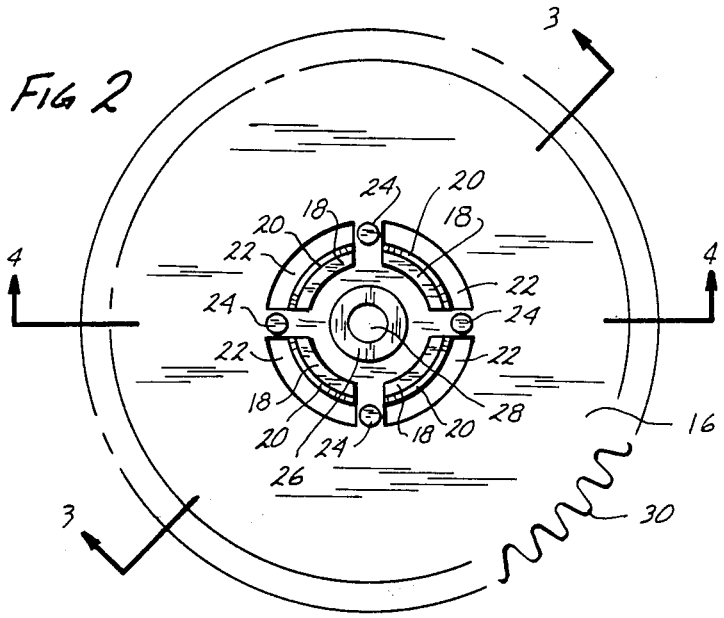
FIG. 2 is a top plan view of a typical gear used with the rotating gear accessory.
Figure 5:
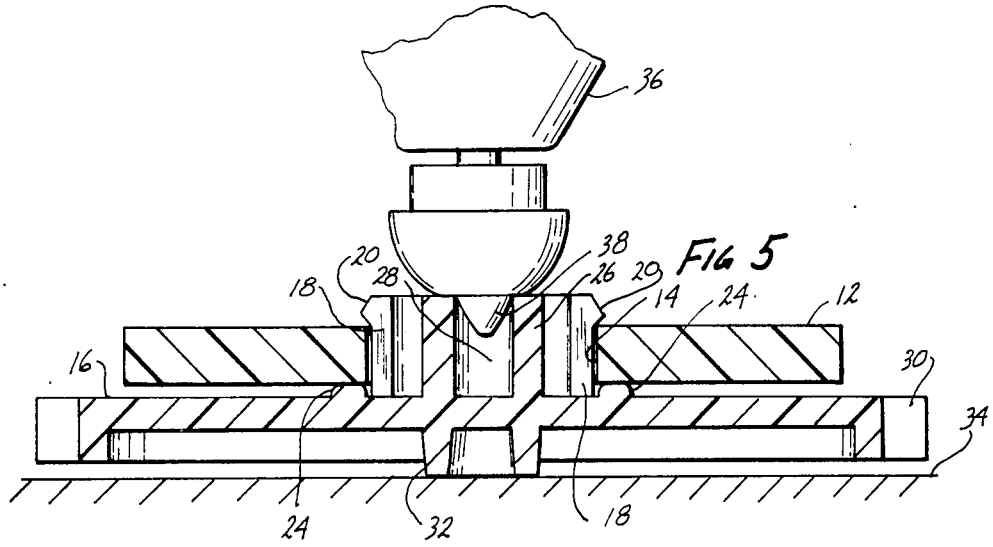
FIG. 5 is a partial cross-sectional view of the top rotating gear accessory and gyroscopic top of FIG. 1 taken in the direction of arrows 5—5.

As best shown in FIG. 5, the gears 16 are removably attached to the supporting body 12 by flexible members 18 extending upward from the upper surface of each gear. Preferably, the flexible members 18 are segmented, curved or shaped as shown in FIG. 2. Any desirable number of members 18 may be used. Also, the shape of the flexible members may be varied if desired. Each gear 16 may be attached to the supporting body 12 by bending one or more of the flexible members 18 of the gear until the members fit through one of the apertures 14. After the members 18 are forced through the aperture 14, protuberances 20 hold the gear 16 in position as shown in FIG. 5. The gear 16 may be removed from the supporting body 12 if desired by simply bending one or more of the flexible members 18 until the members are free to slide out of the aperture 14. Curved slots 22 (see FIGS. 2 and 3) passing through the gear 16 are used for manufacturing purposes.

Referring again to FIG. 5, upward protuberances 24 located on the top of each gear 16 provide support for the supporting body 12 and clearance between the gears and the body. The protuberances 24 assist in reducing friction between the gears 16 and the body 12 during operation of the accessory 10. After the gears 16 are attached to the supporting body 12, each gear is free to frictionally rotate with respect to the supporting body 12 due to clearances between the flexible members 18 and the apertures 14.

Figure 3:
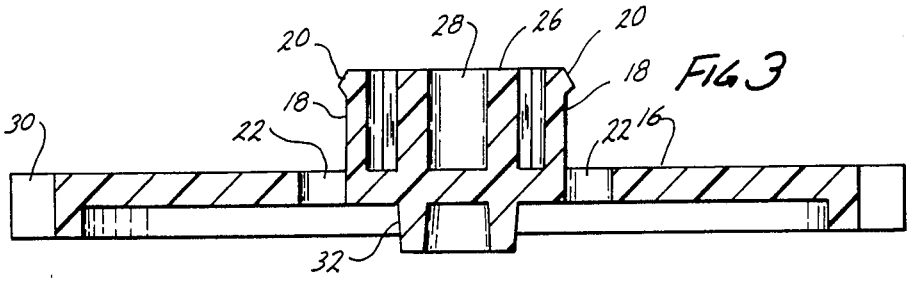
FIG. 3 is a cross-sectional view of the gear of FIG. 2 taken in the direction of arrows 3—3.
Figure 4:
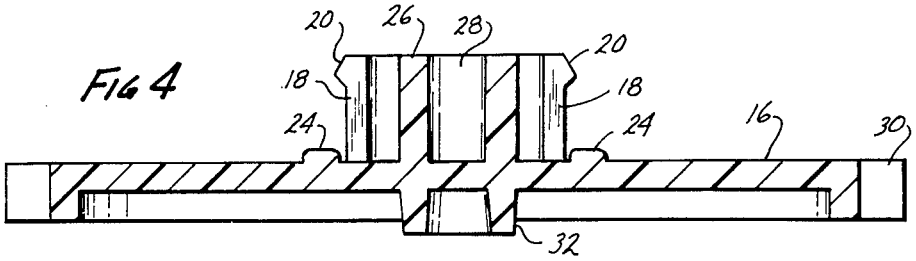
FIG. 4 is a cross-sectional view of the gear of FIG. 2 taken in the direction of arrows 4—4.

As shown in FIGS. 3 through 5, each gear 16 has an upwardly—extending generally cylindrically—shaped portion 26 with a cylindrical bore 28 therein and a bottom support 32. Teeth 30 are located at the outer circumference of each gear 16.

After the gears 16 are attached to the supporting body 12, bottom supports 32 support the toy rotating gear accessory 10 on a horizontal playing surface 34 as shown in FIG. 5. The accessory 10 may then be used in conjunction with a gyroscopic top 36 by placing the rotating bottom portion 38 of the top in the cylindrical bore 28 of one of the gears 16 (see FIG. 5). As a result, portion 38 will cause the gear 16 to frictionally rotate with respect to the supporting body 12.

FIG. 1 shows how the gyroscopic top 36 may be used during play with three gears 16 attached to the supporting body 12. Note that the gears 16 are designed and the apertures 14 located so that the teeth 30 of the gears engage each other as shown in FIG. 1 when the three gears are attached to the body 12. After a child causes bottom portion 38 of the top 36 to rotate, portion 38 may be inserted into cylindrical bore 28 of the central gear 16. If the top 36 is rotating in the direction of arrow 40, it will cause the gears 16 to rotate in accordance with arrows 44 and 46 as the teeth 30 of the gears engage each other. The gyroscopic effect of the top 36 will then cause the toy rotating gear accessory 10 to rotate in the direction of arrows 48 about the center of the central gear 16 as the bottom supports 32 frictionally slide on surface 34.

Referring now to FIG. 6, the top 36 is shown engaging only one gear 16. As a result, rotation of the top 36 in the direction of arrow 40 will cause the gear 16 to rotate in the direction of arrow 42 and the toy rotating gear accessory 10 to rotate about the center of the gear in the direction of arrows 50. It is important to note that the accessory 10 may be used with the gears 16 in positions other than those shown in FIGS. 1 and 6 if desired.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

We claim:

1. A toy rotating gear accessory for use with a gyroscopic top, comprising:

a supporting body having a plurality of apertures passing therethrough; and a plurality of gears removably and rotatably engaged to said supporting body, each of said gears having (a) teeth means at the outer circumference thereof for engaging at least one other of said teeth means of another of said gears, (b) upwardly-extending flexible member means attached thereto for removably enaging one of said apertures, (c) support means attached thereto for supporting said rotating gear accessory on a horizontal surface, (d) an upwardly-extending portion with an aperture therein, said aperture in said portion adapted for engaging said gyroscopic top and (e) a number of protuberances located on the top surface thereof, said protuberances adapted for supporting said body so that said body rests on top of said protuberances and clearance is provided between said top surface and said body.

2. The toy rotating gear accessory of claim 1 wherein said apertures in said supporting body are located so that said teeth means of each of said gears is capable of engaging said teeth means or at least one other of said gears when said gears are engaged to said supporting body.

3. The toy rotating gear accessory of claim 2 wherein said supporting body is relatively flat.

4. The toy rotating gear accessory of claim 3 wherein each of said flexible member means has protuberance near the upper end thereof.

5. A toy rotating gear accessory for use with a gyroscopic top, comprising:

a relatively flat supporting body having a plurality of apertures passing therethrough; and a plurality of circular-shaped gears removably and rotatably engaged to said supporting body, each of said gears having (a) teeth means at the outer circumference thereof for engaging at least one other of said teeth means of another of said gears, (b) segmented flexible members extending in an upward direction from the upper surface thereof, each of said members having a protuberance at the upper end thereof, said members adapted for engaging one of said apertures, (c) support means attached to the lower surface thereof and located near the center thereof for supporting said rotating gear accessory on a horizontal surface, (d) a generally cylindrically-shaped portion extending upward from said upper surface having a cylindrical bore therein adapted for engaging said gyroscopic top, and (e) protuberances located on said upper surface adjacent to said flexible members, said protuberances adapted for supporting said body so that said body rests on top of said protuberances and clearance is provided between said upper surface and said body, said apertures in said body being located so that said teeth means of each of said gears is capable of engaging said teeth means of at least one other of said gears when said gears are engaged to said body, said gears capable of rotating with respect to said body when engaged to said body.

* * * * *